US008986064B2

(12) United States Patent
Spielberger et al.

(10) Patent No.: US 8,986,064 B2
(45) Date of Patent: Mar. 24, 2015

(54) MODULAR TRACK FOR MODEL VEHICLES

(71) Applicant: Hasbro, Inc., Pawtucket, RI (US)

(72) Inventors: Lee Spielberger, Warwick, RI (US); Eric Listenberger, Portsmouth, RI (US)

(73) Assignee: Hasbro, Inc., Pawtucket, RI (US)

( * ) Notice: Subject to any disclaimer, the term of this patent is extended or adjusted under 35 U.S.C. 154(b) by 252 days.

(21) Appl. No.: 13/627,026

(22) Filed: Sep. 26, 2012

(65) Prior Publication Data

US 2014/0087621 A1 Mar. 27, 2014

(51) Int. Cl.

| | |
|---|---|
| ***A63H 33/08*** | (2006.01) |
| ***A63H 18/02*** | (2006.01) |
| ***A63H 18/08*** | (2006.01) |

(52) U.S. Cl.

CPC ..... *A63H 18/028* (2013.01); *A63H 18/08* (2013.01)

USPC ..... 446/108

(58) Field of Classification Search

CPC ..... A63H 19/00; A63H 19/28; A63H 19/30; E01B 23/04

USPC ..... 446/108, 112, 114, 115, 116; 238/10 R, 238/10 E, 10 F; D21/565

See application file for complete search history.

(56) References Cited

U.S. PATENT DOCUMENTS

| | | | | | |
|---|---|---|---|---|---|
| 2,000,808 | A | * | 5/1935 | Williams | 446/168 |
| 2,534,458 | A | | 12/1950 | Larrabee | |
| 2,764,357 | A | | 9/1956 | Katryniak | |
| 3,487,999 | A | | 1/1970 | Nash et al. | |
| 3,581,988 | A | | 6/1971 | Kin et al. | |
| 3,592,384 | A | | 7/1971 | Tomaro | |
| 3,712,539 | A | | 1/1973 | Staats | |
| 3,712,540 | A | | 1/1973 | Yamasaki et al. | |
| 3,734,404 | A | | 5/1973 | Baynes et al. | |
| 4,091,995 | A | | 5/1978 | Barlow et al. | |
| 4,352,329 | A | | 10/1982 | Fetty et al. | |
| 4,357,877 | A | | 11/1982 | Mariol | |
| 4,382,599 | A | * | 5/1983 | Tilbor | 463/59 |
| 4,397,419 | A | | 8/1983 | Fischer | |
| 4,504,012 | A | * | 3/1985 | Fetty et al. | 238/10 F |
| 4,544,094 | A | * | 10/1985 | Scholey | 238/10 R |
| 4,558,867 | A | | 12/1985 | Hippely | |
| 4,697,812 | A | * | 10/1987 | Rudell et al. | 104/305 |
| 4,715,843 | A | | 12/1987 | Ostendorff et al. | |
| D296,804 | S | * | 7/1988 | Bach et al. | D21/565 |
| 4,898,326 | A | | 2/1990 | Edwards et al. | |
| 4,951,872 | A | | 8/1990 | Sheffield | |
| 4,953,785 | A | * | 9/1990 | Keska | 238/10 A |
| 5,279,871 | A | | 1/1994 | Segan et al. | |

(Continued)

*Primary Examiner* — Kurt Fernstrom

(74) *Attorney, Agent, or Firm* — Greenberg Traurig, LLP; David J. Dykeman; Roman Fayerberg

(57) ABSTRACT

Modular tracks for model vehicles are disclosed. In some embodiments, a track of the present disclosure includes a plurality of track sections, each track section including at least one upper and lower surface and at least one end. In some embodiments, a first track section of the plurality of track sections includes a female connector and a male connector located in a first track section end region and a second track section of the plurality of track sections includes a male connector and a female connector located in a second track end region. In some embodiments, the female connector of the first track section correspondingly interconnects with the male connector of the second track section and the female connector of the second track section correspondingly interconnects with the male connector of the first track section to interconnect the first track section and the second track section.

7 Claims, 6 Drawing Sheets

(56) References Cited

U.S. PATENT DOCUMENTS

| | | | | | |
|---|---|---|---|---|---|
| 5,405,080 | A | | 4/1995 | Yeung et al. | |
| 5,564,962 | A | * | 10/1996 | Navarrete Espinosa | 446/128 |
| 5,779,145 | A | | 7/1998 | Zelle et al. | |
| 5,908,343 | A | | 6/1999 | Rothbarth et al. | |
| D412,949 | S | * | 8/1999 | Nielsen | D21/564 |
| 6,647,893 | B1 | | 11/2003 | Fugitt et al. | |
| 6,883,719 | B2 | | 4/2005 | Pyrce | |
| 6,951,307 | B2 | | 10/2005 | Lin | |
| 6,974,086 | B2 | * | 12/2005 | Cheng | 238/10 F |
| 7,354,006 | B1 | | 4/2008 | Bricker | |
| D573,665 | S | * | 7/2008 | Horikoshi | D21/565 |
| 7,963,456 | B2 | * | 6/2011 | Stadlbauer | 238/10 F |
| D651,661 | S | * | 1/2012 | Yuen | D21/565 |
| D660,379 | S | * | 5/2012 | Glickman | D21/565 |
| 8,328,111 | B2 | | 12/2012 | Mielke et al. | |
| D689,141 | S | * | 9/2013 | Mimlitch et al. | D21/565 |
| 2005/0173551 | A1 | | 8/2005 | Lin | |
| 2005/0247800 | A1 | | 11/2005 | Pyrce | |
| 2011/0186645 | A1 | | 8/2011 | Mielke et al. | |

* cited by examiner

MODULAR TRACK FOR MODEL VEHICLES

FIELD

This patent specification relates to a modular track system for model vehicles, and more particularly to connectors for joining individual track sections to form a modular track for model vehicles.

BACKGROUND

Modular tracks for model vehicle are generally constructed from a plurality of track sections interconnected with one another. Various types of systems for connecting adjacent track sections have been developed. These systems, however, suffer from a number of shortcomings. For example, some of the existing connection systems may be difficult to manipulate and thus are not suitable for children and some adults. Some existing systems are also not able to prevent lateral movement of track section relative to one another. Accordingly, there is still a need for an improved system for connecting adjacent track sections of a modular track.

SUMMARY

Aspects of the present disclosure relate to a modular track for model vehicles comprising a plurality of interconnected track sections.

According to some embodiments, a track for model vehicles of the present disclosure includes a plurality of track sections, each track section including at least one upper and lower surface and at least one end. In some embodiments, a first track section of the plurality of track sections includes a female connector structure and a male connector structure located in a first track section end region, and a second track section of the plurality of track sections includes a male connector structure and a female connector structure located in a second track end region. In some embodiments, the female connector structure of the first track section correspondingly interconnects with the male connector structure of the second track section and the female connector structure of the second track section correspondingly interconnects with the male section of the first track section to interconnect the first track section and the second track section.

According to some embodiments, a track for model vehicles includes a plurality of track sections, each track section having at least one male connector structure and at least one female connector structure, the connector structures extending at least partially beyond at least one end of the track section, wherein a male connector structure of a first track section of the plurality of track sections is concentrically engageable with a female connector structure of an adjacent track section of the plurality of track sections; and a female connector structure of the first track section is concentrically engageable with a male connector structure of the adjacent track section to interconnect the first track section and the adjacent track section.

In some embodiments, the female connector structure of the first track section includes at least one cavity and the female connector structure of the second track section includes at least one cavity.

In some embodiments, the male connector structure of the first track section correspondingly interconnects into the at least one cavity of the female connector structure of the second track section from a direction of a lower surface to an upper surface and the male connector structure of the second track section correspondingly interconnects into the at least one cavity of the female connector structure of the first track section from a direction of a lower surface to an upper surface.

In some embodiments, the female and the male connector structures of the first track section extend upwardly from the upper surface of the first track section, and the female and the male connector structures of the second track section extend upwardly from the upper surface of the second track section.

In some embodiments, the male connector structure of the first track section is concentrically fitted into the female connector structure of the second track section and the male connector structure of the second track section is concentrically fitted into the female connector structure of the first section.

In some embodiments, the connector structures at least partially extend beyond the sides and end of a body of the first and second track sections.

In some embodiments, the female connector structures are contiguous with a body of the first and second track sections and the male connector structures are spaced away from the body of the first and second sections.

In some embodiments, the male connector structures are disposed on a lower plane than the female connectors.

According to some embodiments, a track for model vehicles is provided, the track including a first track section having a first pylon and a second pylon disposed along an end region of the first track section and a second track section having a third pylon and a fourth pylon disposed along an end region of the second track section, the third and the fourth pylons are designed complimentary to the first and second pylon, respectively. In some embodiments, to interconnect the first track section and the second track section, the first pylon receives the third pylon into a cavity underneath the first pylon and the second pylon is inserted into a cavity underneath the fourth pylon.

In some embodiments, the third pylon interconnects into the cavity underneath the first pylon from a direction of a lower surface to an upper surface of the first track section and the second pylon interconnects into the cavity underneath the fourth pylon from a direction of a lower surface to an upper surface of the second track section.

In some embodiments, the first and second pylons extend upwardly from an upper surface of the first track section and the third and fourth pylons extend upwardly from an upper surface of the second track section.

In some embodiments, the third pylon concentrically fits into the first pylon and the second pylon concentrically fits into the fourth pylon.

In some embodiments, the pylons at least partially extend beyond the sides of the first and second track sections.

In some embodiments, the first pylon and the fourth pylon are contiguous with the first and second track sections and the second pylon and third pylon are spaced away from the first and second sections.

In some embodiments, the first pylon is disposed on a higher plane than the second pylon and the fourth pylon is on a higher plane than the third pylon.

Further features and advantages will become more readily apparent from the following detailed description when taken in conjunction with the accompanying drawings.

BRIEF DESCRIPTION OF THE DRAWINGS

The present disclosure is further described in the detailed description which follows, in reference to the noted plurality of drawings by way of non-limiting examples of exemplary embodiments. The drawings shown are not necessarily to scale, with emphasis instead generally being placed upon illustrating the principles of the presently disclosed embodiments, and wherein.

Figure 1:
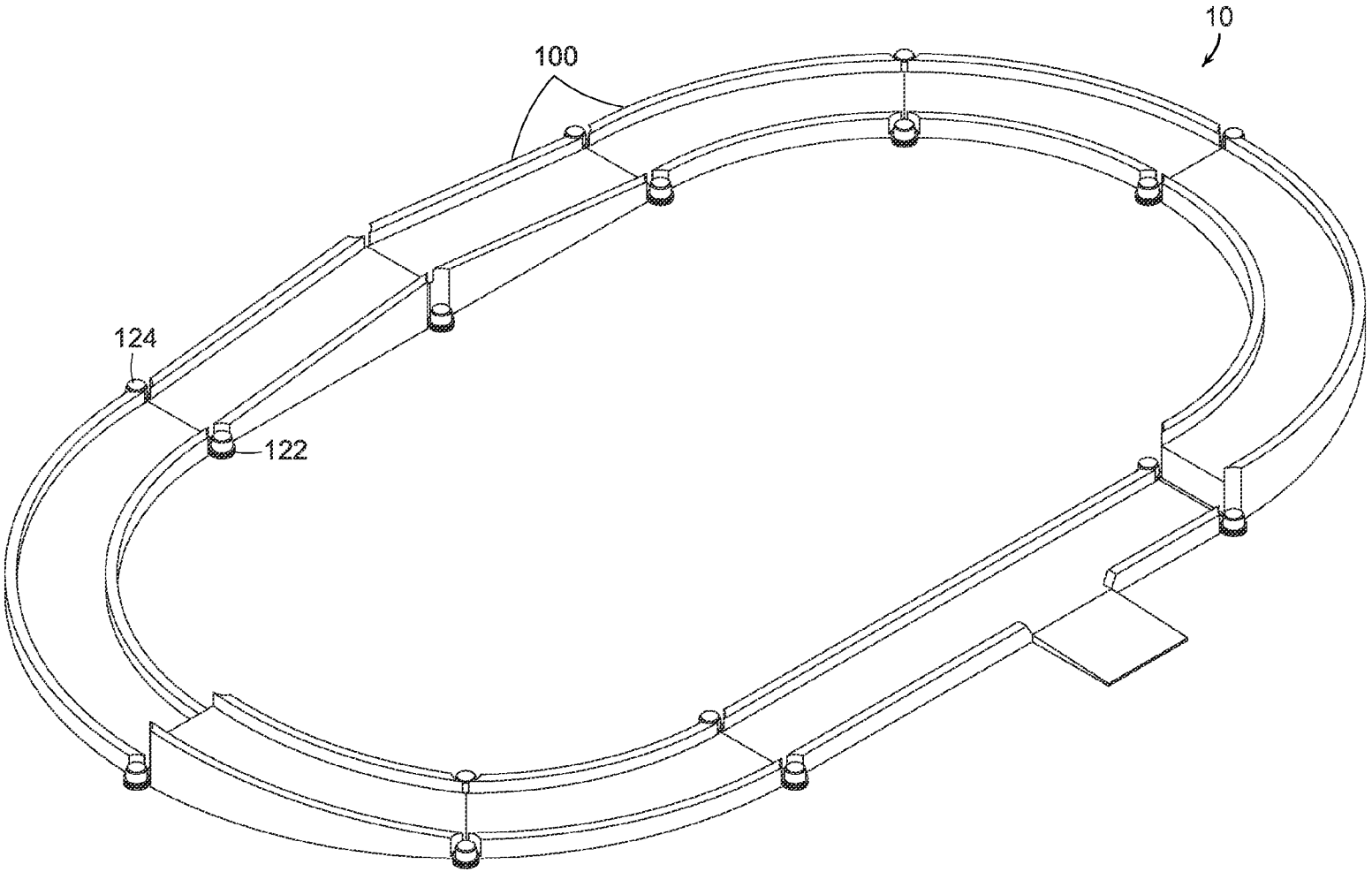
FIG. 1 is a prospective view of an embodiment track of the present disclosure including a plurality of interconnected track sections.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments, it being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Aspects of the present disclosure relate to a modular track system for model vehicles, such as trains or cars. FIG. 1 illustrates a non-limiting embodiment of a modular track 10 formed by a plurality of track sections 100 interconnected with one another. The shapes of adjacent track sections may vary as long as a continuous, substantially smooth track is formed to enable model vehicles to travel along the track with minimal interruptions. While FIG. 1 illustrates a generally oval track, the plurality of track sections 100 may have various shapes to form a continuous track of any desired shape, including, but not limited to, oval, circle, figure eight loops or another shape.

Figure 2A:
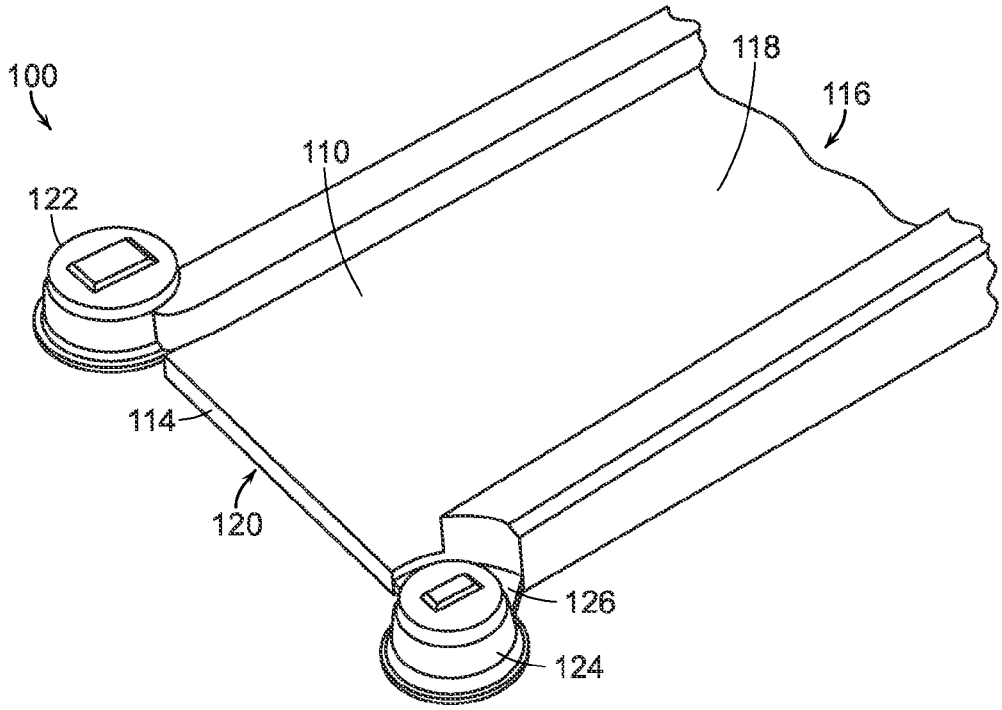
FIG. 2A, FIG. 2B, FIG. 2C, and FIG. 2D illustrate some embodiments of a track section.
Figure 2B:
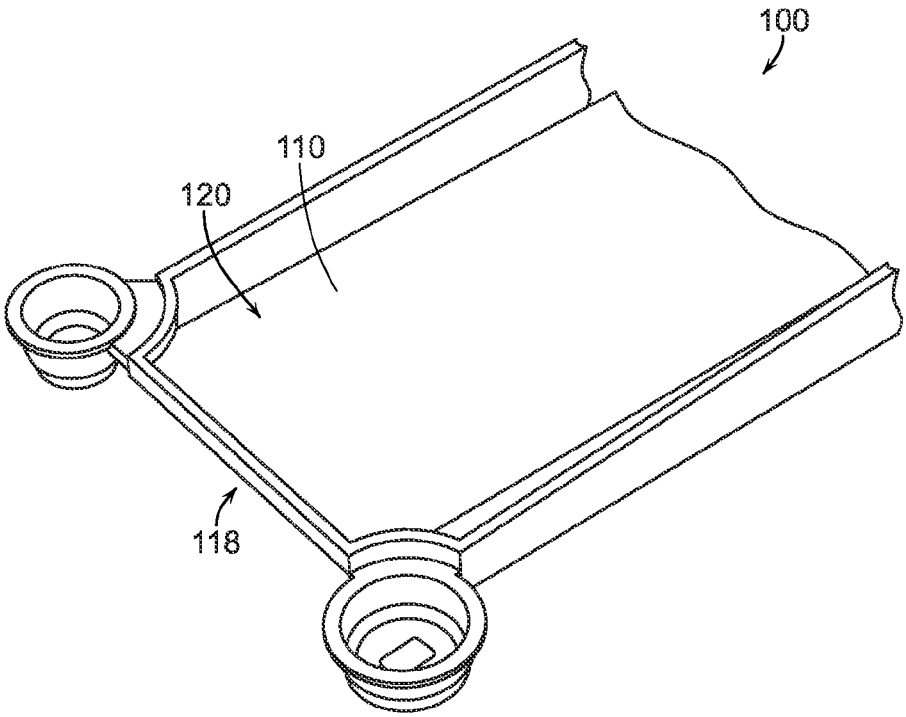
Figure 2C:
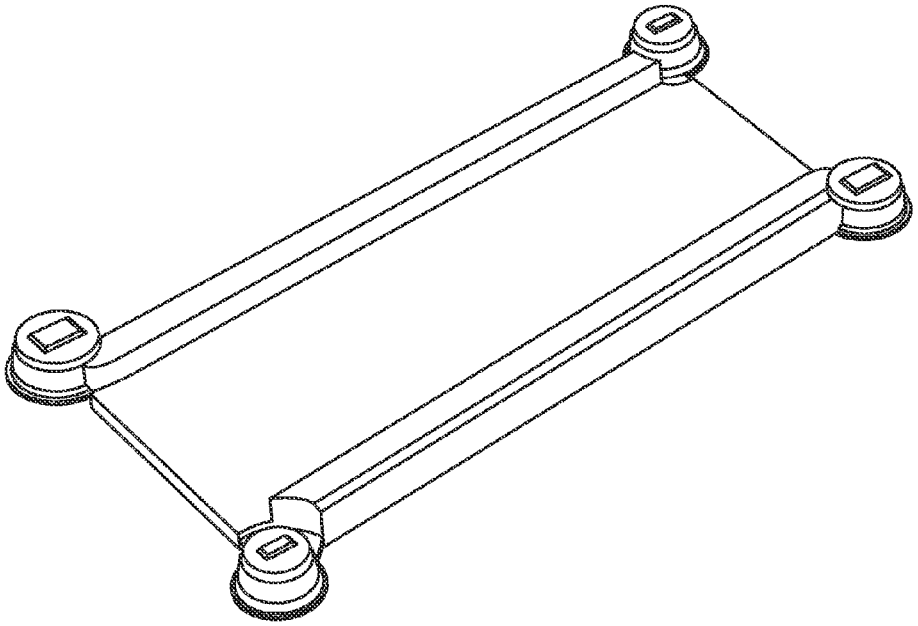
Figure 2D:
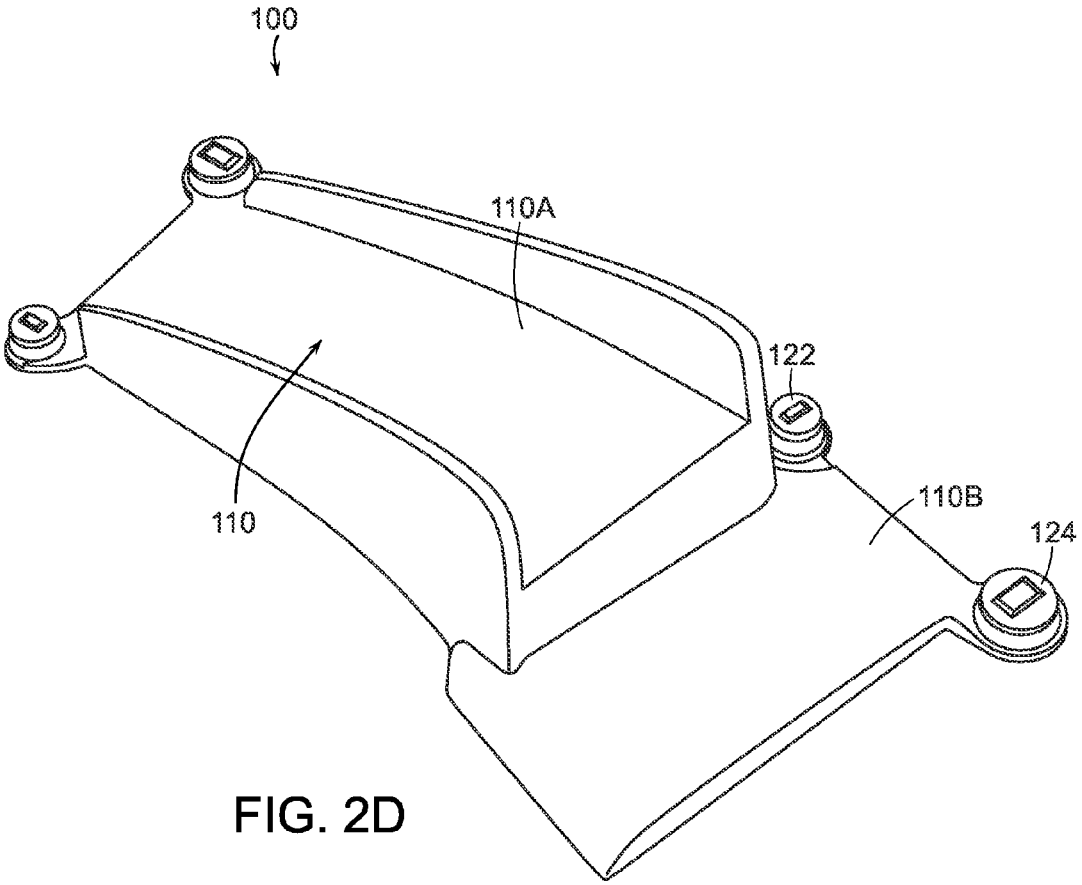

In reference to FIG. 2A and FIG. 2B, each track section 100 has a body portion 110 having a first end region 114 and a second end region 116. The body portion 110 of the track section 110 can be straight, arched or curved. By way of a non-limiting example, FIG. 2C illustrates a track section with a straight body portion. In some embodiments, the body portion 110 may include multiple body sections connected at an angle relative to one another. For example, as shown in FIG. 2D, the body 100 of the track section 100 includes a first body portion 110A disposed at a right angle relative to a second body portion 110B. The first body portion 110A may be have a length similar or different that the length of the second body portion 110B.

As shown in FIG. 2A and FIG. 2B, the body portion 110 of each track section 100 further includes a first surface 118 and a second surface 120. The first surface 118 may be planar or may include a ramp for a length of the first surface 118. In some embodiments, the first surface 118 is made to resemble a thoroughfare, such as for example, a railroad track, a roadway, a canal, or a similar structures for vehicles to move upon. In some embodiments, the first surface 118 may include raised curbs or sidewalls on either side to define the thoroughfare. The first surfaces of adjacent track sections may vary as long as a continuous, substantially smooth track is formed to enable model vehicles to move along the track.

The second surface 120 of the body portion 110 may be of any shape or configuration suitable to support the toy track on a supporting surface, such as a floor or a table. In some embodiments, the second surface 120 may also be made to resemble a thoroughfare, preferably different than that of the first surface 118. In some embodiments, the first surface 118 and the second surface 120 are configured such that the toy track may be used with either one of the surfaces facing upward and the opposite surface actions as supporting surface. For the ease of description, the surface facing upwards so that the vehicles can drive on that surface may be referred to herein as the upper surface, while the surface facing downward may be referred to herein as the lower surface. This naming convention also applies to other features of track sections.

As shown in FIG. 2A and FIG. 2B, each track section 100 also includes a pair of connectors 122, 124 situated about the first end 114 of the body portion 110. The second end 116 of the body portion 110 may also include a pair of connectors 122, 124. In some embodiments, the second end 116 of the body portion 110 may include connectors that are of different type than the connectors 122, 124 at the first end 114. In some embodiments, the second end 116 of the body portion 110 may include no connectors. In some embodiments, the connectors 122, 124 are cone shaped. In some embodiments, the connectors 122, 124 are pylon-shaped, extending upward from the upper surface of the track section 100. It should be noted, however, that while the figures illustrate pylon-shaped connectors 122, 124, the connectors 122, 124 can be of any other shape.

In some embodiments, the connectors 122, 124 are situated about the end 114 of the body portion 110. In some embodiments, the connectors 122, 124 are offset a distance from the end 114 of the body portion 110. The connectors 122, 124 may project away from the body portion 110 of the track section 100 to enable adjacent track sections to be connected to form an uninterrupted upper surface. In some embodiments, at least 2 connectors 122, 124 extend from the corners of the track section 100. In some embodiments, the connectors 122, 124 may at least partially extend beyond the end of the body portion 110 in the longitudinal direction of the body portion 110.

In some embodiments, the connectors 122, 124 at least partially extend radially or sideways beyond the sides of the body portion 110. To that end, the connectors 122, 124 may be set at an angle relative to the body portion 110. In some embodiments, because the connectors 122, 124 at least partially extend beyond the end 114 of the body portion 110, the connectors 122, 124 provide a lateral support for the track section 100.

In some embodiments, the connectors 122, 124 can be spaced away from the body portion 110 by a connector bridge 126, such as the connector 124. Alternatively, some connectors can be contiguous with the body, such as, for example, the connector 126. In some embodiments, the connectors 122, 124 may be disposed at a different level relative to the top surface of the track section 100 so that one connector is higher than the other connector.

Figure 3:
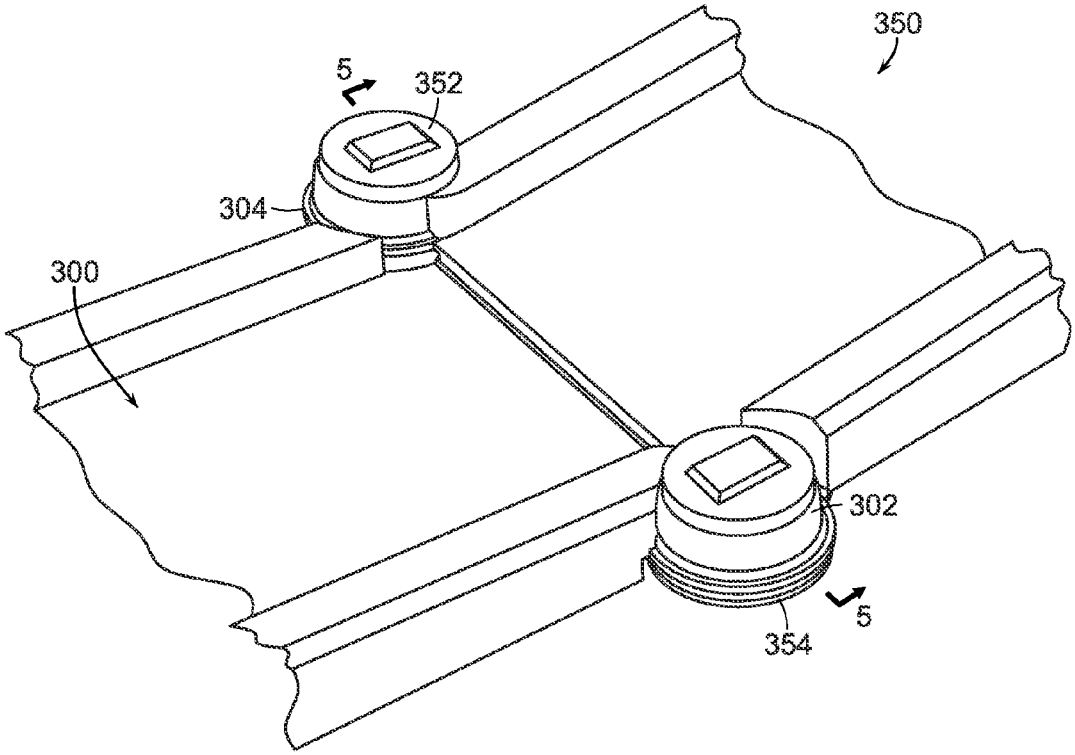
FIG. 3 is a close up of a section of a toy track of the present disclosure.

Referring to FIG. 3, in some embodiments, adjacent track sections 300, 350 are interconnected by mating connectors 302, 304 of the first track section 300 with connectors 352, 354 of the second track section 350 to create a continuous track 310. For example, to interconnect the track sections 352 and 354, as shown in FIG. 3, the first track section 300 may be provided with a male connector 304 and a female connector 302, while the second track section 350 may be provided with a male connector 354 and a female connector 352 designed to mate with the female connector 304 and male connector 302 of the first track section, respectively. To connect adjacent track sections 300, 350 together, the connectors 302, 304 of the first section 300 and connectors 352, 354 of the second track section are complimentary-shaped to enable interconnection of the connectors 302, 304 of the first section 300 with connectors 352, 354 of the second section 350. For example, when the first track section 300 and the second track section 350 are positioned in an end-to-end alignment with one another, as shown in FIG. 3, the male connector 304 of the first track section 300 and the female connector 352 of the second track section 350 are positioned on one side of the track 310, while the male connector 354 of the second track section 350 and the female connector 302 of the first track section 300 are on the opposite side of the track 310. In some embodiments, the female connector 302 of the first track section 300 is configured to correspondingly interconnect with the male connector 354 of the second track section 350 and the female connector 352 of the second track section 350 is configured to correspondingly interconnect with the male connector 304 of the first track section 300.

The female connectors 302, 304 and the male connectors 304, 354 may be interconnected by a variety of joining techniques, including, but not limited to, snap fit, friction fit, or another type of detachable fit.

In some embodiments, the connectors 302, 304, 352, 354 are designed so as to allow repeated engagement and detachment of the track sections 300, 350.

Figure 4A:
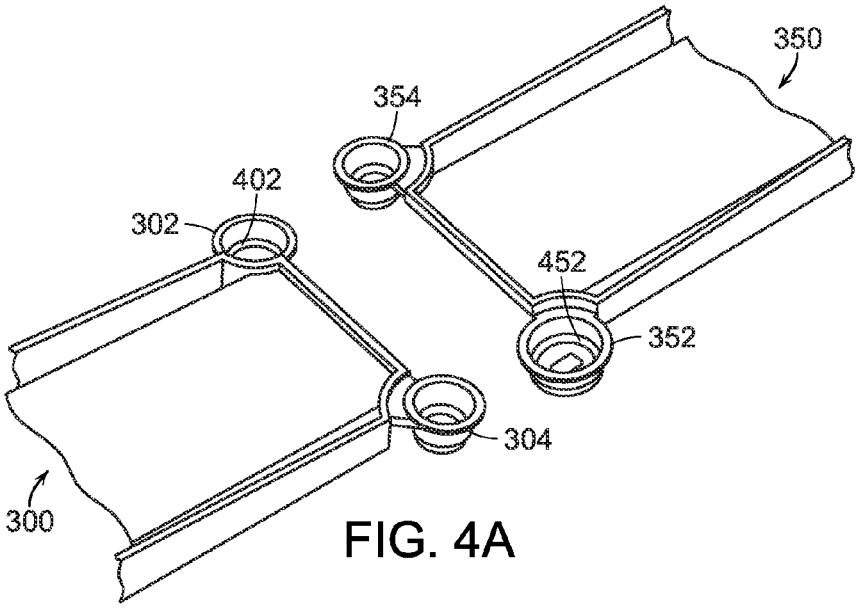
FIG. 4A, FIG. 4B, and FIG. 4C illustrate a non-limiting example of an interconnection between two track sections.
Figure 4B:
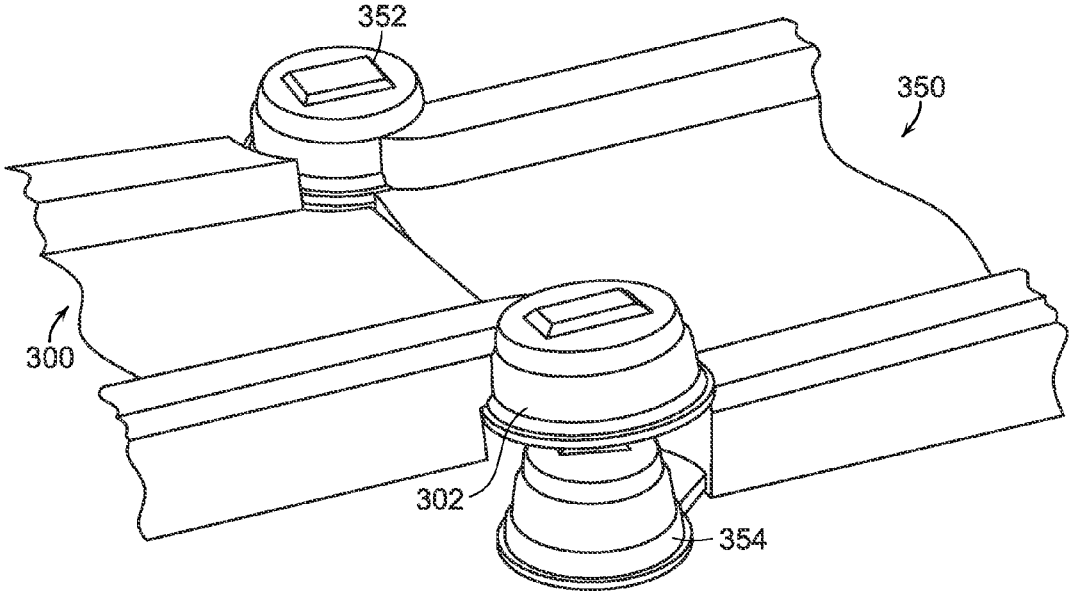
Figure 4C:
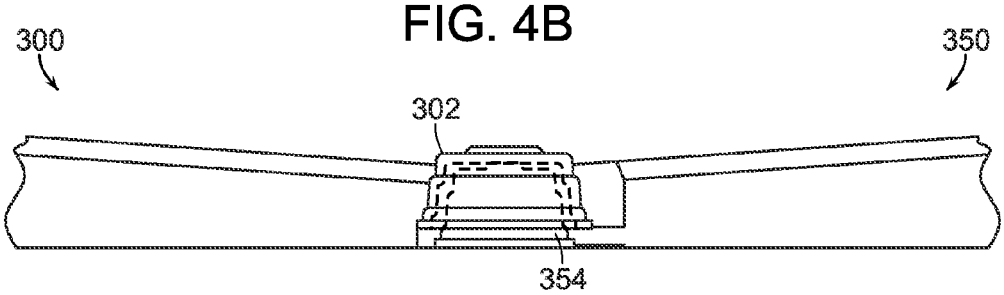

In reference to FIG. 4A, the female connectors 302, 352 may be designed as a receptacle that receives and holds the male connectors 304, 354, respectively. In some embodiments, the male connectors 304, 354 are designed to concentrically fit in the corresponding female connector 302 or 352. In some embodiments, the female connectors 302, 352 may include a cavity 402, 452, respectively, configured to complimentary receive male connectors 304, 354 of the adjacent section, as shown in FIG. 4C. In some embodiments, the cavities 402, 452 are configured to securely receive a corresponding male connector 304, 354. In some embodiments, female connectors 302, 352 can be shaped to define a cavity within the female connectors 302, 352. In some embodiments, the cavity 402, 452 may be underneath the female connectors 302, 352, as shown, for example, in FIG. 4A. In some embodiments, the cavities 402, 452 are configured to enable a corresponding male connector 304, 354 to be securely inserted into the respective cavity 402, 452 from underneath the female connectors 302, 352, that is, from a direction of the lower surface to the upper surface of the male connector, as illustrated in FIG. 4B. In some embodiments, the male connectors 304, 354 are connected to the body of the track section with the 126 connector bridge to facilitate insertion of the male connector into the female connector, as shown in FIG. 4B and FIG. 4C. In some embodiments, the cavity 402, 452 may have a side opening. In some embodiments, the side opening into the cavities 402, 452 may be disposed on the front side of the female connectors 302, 352 to enable insertion of the male connectors 304, 354 into the female connectors 302, 352 as the first track section 300 and the second track section 350 are positioned end to end.

By way of a non-limiting example, the female connectors 302, 352 and the male connectors 304, 354 may be pylon-shaped. The female connector pylons and the male connector pylons may be sized and shaped such that the male connector pylons may be correspondingly interconnect with the female connector pylons. In some embodiments, the female connector pylons define a cavity underneath the female connector pylons designed to correspondingly accept the male connector pylons therein. To interconnect two sections, the male connector pylons of each section are inserted into the cavity of the female connector pylons of the other section from a direction of the lower surface to the upper surface of the track sections.

Figure 5:
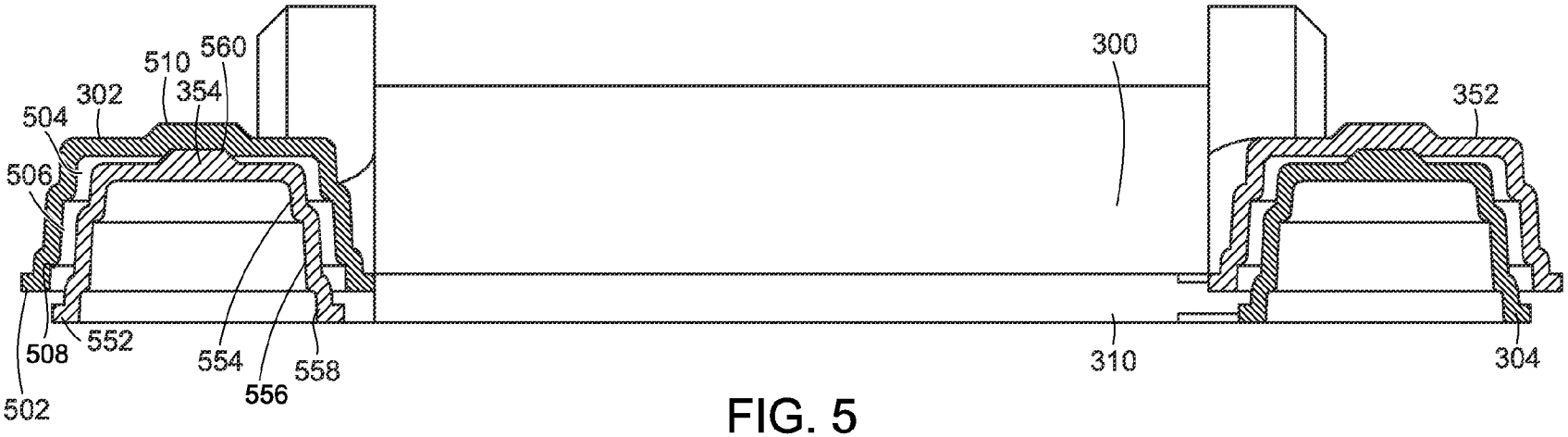
FIG. 5 is a cross-sectional view of an interconnection between two track sections.

FIG. 5 is a cross-sectional view along line 5-5 in FIG. 3, showing two adjacent sections 300 and 350 interconnected. By way of a non-limiting example, the female connector 302 includes a base 502 and a cavity divided into multiple sections 504, 506, 508 of varying diameter. In some embodiments, the diameters of the sections 504, 506, 508 decreases from the base 502 up in the direction of a lower surface to an upper surface. The diameter of the section 504 is thus smaller than the diameter of the section 506 and of the section 508. The diameter of the section 506 is larger than the diameter of the section 504 and smaller than the diameter of the section 508.

In some embodiment, as shown in FIG. 5, the sections 504, 506, 508 may be of the same height of different heights. By way of a non-limiting example, the section 508 may have a shorter length than the length of the section 504, which in turn may have a shorter length than the length of the section 506.

The male connector 354 may also be provided with a base 552 and three sections 554, 556, and 558 of varying diameter complimentary to the base 502 and three sections 504, 506, and 508 of the female connector 302 to interconnect the female connector 302 with the male connector 354.

In some embodiments, the female connector 302 and the male connector 354 may include complimentary shaped locking buttons 510, 560 to further stabilize and reinforce the interlocking of the female connector 302 with the male connector 354.

As shown in FIG. 5, by way of a non-limiting example, to interconnect the first track section 300 and the second track section 350, the female connector 302 of the first section 300 and the male connector 354 of the second section 350 are complimentary to one another such that the male connector 354 can be correspondingly received within the cavity defined by the female connector 302 to form a secure connection between the female connector 302 and male connector 354. Similarly, the male connector 304 of the first section 300 and the female connector 352 of the second section 350 are complimentary to one another such that the male connector 304 can be correspondingly received within the cavity defined by the female connector 352 to form a secure connection between the female connector 352 and male connector 304.

In some embodiments, as shown in FIG. 5, the female and male connectors of each section are disposed at different heights. In some embodiments, the male connector of a track section is disposed at a lower plane than the female connector of that track section. In this manner, when two track sections are connected, the upper surfaces of the two track sections are levelled and form a substantially smooth upper surface between the two track sections.

In some embodiments, a track for model vehicles of the present disclosure includes a plurality of track sections, each track section including at least one upper and lower surface and at least one end. In some embodiments, a first track section of the plurality of track sections includes a female connector structure and a male connector structure located in a first track section end region and a second track section of the plurality of track sections includes a male connector structure and a female connector structure located in a second track end region. In some embodiments, the female connector structure of the first track section correspondingly interconnects with the male connector structure of the second track section and the female connector structure of the second track section correspondingly interconnects with the male section of the first track section to interconnect the first track section and the second track section.

In some embodiments, a track for model vehicles includes a plurality of track sections, each track section having at least one male connector structure and at least one female connector structure, the connector structures extending at least partially beyond at least one end of the track section, wherein a male connector structure of a first track section of the plurality of track sections is concentrically engageable with a female connector structure of an adjacent track section of the plurality of track sections; and a female connector structure of the first track section is concentrically engageable with a male connector structure of the adjacent track section to interconnect the first track section and the adjacent track section.

In some embodiments, a track for model vehicles is provided, the track including a first track section having a first pylon and a second pylon disposed along an end region of the first track section and a second track section having a third pylon and a fourth pylon disposed along an end region of the second track section, the third and the fourth pylons are designed complimentary to the first and second pylon, respectively. In some embodiments, to interconnect the first track section and the second track section, the first pylon receives the third pylon into a cavity underneath the first pylon and the second pylon is inserted into a cavity underneath the fourth pylon.

The disclosure has been described with reference to particular preferred embodiments, but variations within the spirit and scope of the disclosure will occur to those skilled in the art. It is noted that the foregoing examples have been provided merely for the purpose of explanation and are in no way to be construed as limiting of the present disclosure. While the present disclosure has been described with reference to exemplary embodiments, it is understood that the words which have been used herein are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

All patents, patent applications, and published references cited herein are hereby incorporated by reference in their entirety. While the methods of the present disclosure have been described in connection with the specific embodiments thereof, it will be understood that it is capable of further modification. Furthermore, this application is intended to cover any variations, uses, or adaptations of the methods of the present disclosure, including such departures from the present disclosure as come within known or customary practice in the art to which the methods of the present disclosure pertain, and as fall within the scope of the appended claims.

What is claimed is:

1. A track for model vehicles, the track comprising:

a first track section having a first pylon and a second pylon extending from an end region of the first track section; and a second track section having a third pylon and a fourth pylon extending from along an end region of the second track section, the third pylon and the fourth pylon are designed complimentary to the first pylon and second pylon, wherein the first pylon receives the third pylon into a cavity underneath the first pylon and the second pylon is inserted into a cavity underneath the fourth pylon to interconnect the first track section and the second track section.

2. The track of claim 1, wherein the third pylon interconnects into the cavity underneath the first pylon from a direction of a lower surface to an upper surface of the first track section and the second pylon interconnects into the cavity underneath the fourth pylon from a direction of a lower surface to an upper surface of the second track section.

3. The track of claim 1, wherein the first and second pylons extend upwardly from an upper surface of the first track section and the third and fourth pylons extend upwardly from an upper surface of the second track section.

4. The track of claim 1, wherein the third pylon concentrically fits into the first pylon and the second pylon concentrically fits into the fourth pylon.

5. The track of claim 1, wherein the pylons at least partially extend beyond the sides of the first and second track sections.

6. The track of claim 1, wherein the first pylon and the fourth pylon are contiguous with the first and second track sections and the second pylon and third pylon are spaced away from the first and second track sections.

7. The track of claim 1, wherein the first pylon is disposed on a higher plane than the second pylon and the fourth pylon is on a higher plane than the third pylon.

* * * * *